US006497341B1

(12) United States Patent
Motsenbocker

(10) Patent No.: US 6,497,341 B1
(45) Date of Patent: Dec. 24, 2002

(54) DEVICE FOR WARMING AND DISPENSING TOWELS

(76) Inventor: Gregg A. Motsenbocker, 874 Felspar St., San Diego, CA (US) 92169

( * ) Notice: Subject to any disclaimer, the term of this patent is extended or adjusted under 35 U.S.C. 154(b) by 0 days.

(21) Appl. No.: 09/704,337

(22) Filed: Nov. 1, 2000

Related U.S. Application Data

(62) Division of application No. 09/130,472, filed on Aug. 7, 1998, now Pat. No. 6,179,162.

(60) Provisional application No. 60/055,145, filed on Aug. 8, 1997, and provisional application No. 60/064,045, filed on Nov. 3, 1997.

(51) Int. Cl.[7] ..... B65H 1/00

(52) U.S. Cl. ..... 221/63; 221/150 A

(58) Field of Search ..... 221/63, 150 A, 221/150 R; 219/214

(56) References Cited

U.S. PATENT DOCUMENTS

| | | | | | |
|---|---|---|---|---|---|
| 2,735,925 | A | | 2/1956 | Nickolay | 219/43 |
| 3,109,084 | A | | 10/1963 | Walsh | 219/43 |
| 4,107,513 | A | | 8/1978 | Ashford | 219/521 |
| 4,260,871 | A | | 4/1981 | Nagelkerke | 219/222 |
| 4,293,760 | A | | 10/1981 | Smal | 219/222 |
| 4,420,097 | A | | 12/1983 | Mostenbocker | 222/131 |
| 4,478,354 | A | * | 10/1984 | Notheis | 221/63 X |
| 4,495,402 | A | * | 1/1985 | Burdick et al. | 221/150 A |
| 4,648,530 | A | * | 3/1987 | Granger | 221/63 X |
| 4,694,973 | A | * | 9/1987 | Rose et al. | 221/150 A X |
| 4,700,048 | A | * | 10/1987 | Levy | 221/150 A X |
| 4,890,205 | A | * | 12/1989 | Shaffer | 221/150 A X |
| 4,943,705 | A | | 7/1990 | Halloran | 219/385 |
| 5,036,178 | A | | 7/1991 | Orbach | 219/385 |
| 5,210,396 | A | | 5/1993 | Sanders | 219/521 |
| 5,231,266 | A | | 7/1993 | Warren | 219/521 |
| 5,310,084 | A | | 5/1994 | Pittman | 221/150 |
| 5,570,808 | A | * | 11/1996 | Tassoni | 221/63 X |
| 5,700,991 | A | | 12/1997 | Osbern | 219/430 |
| 5,803,249 | A | * | 9/1998 | Harsanyi, Jr. et al. | 206/233 |
| 5,986,239 | A | | 11/1999 | Corrigan, III et al. | 219/385 |
| 6,179,162 | B1 | * | 1/2001 | Motsenbocker | 221/150 A |

FOREIGN PATENT DOCUMENTS

| | | | | |
|---|---|---|---|---|
| WO | WO-87/03271 | * | 6/1987 | 221/150 A |

* cited by examiner

*Primary Examiner*—David H. Bollinger
(74) *Attorney, Agent, or Firm*—Stephanie L. Seidman; Dale L. Rieger; Heller Ehrman White & McAuliffe, LLP

(57) ABSTRACT

A towel dispensing device provides a device for warming towels prior to the towels being removed from the dispensing device. The dispensing device includes an electrically powered heating member, the degree of heat being controllable by the user, for warming the space of a warming chamber containing the towels to be dispensed. The towels to be dispensed can be pre-moistened by water or other fluids as required by the user. The dispensing device can also be presented as a serialized group of warming chambers; each individual chamber being able to contain towels pre-moistened with different fluids and warmed to different temperatures prior to being dispensed.

27 Claims, 4 Drawing Sheets

DEVICE FOR WARMING AND DISPENSING TOWELS

RELATED APPLICATIONS

This application is a divisional of U.S. application Ser. No. 09/130,472 to Motsenbocker, filed Aug. 7, 1998, entitled, "DEVICE FOR WARMING AND DISPENSING TOWELS," now U.S. Pat. No. 6,179,162, issued Jan. 30, 2001. U.S. application Ser. No. 09/130,472 claims priority to U.S. Provisional Application Serial No. 60/055,145, filed Aug. 8, 1997, entitled, "DEVICE FOR WARMING AND DISPENSING TOWELS" and U.S. Provisional Application Serial No. 60/064,045, filed Nov. 3, 1997, entitled "DEVICE FOR WARMING AND DISPENSING TOWELS." Each of the aforementioned applications is hereby incorporated by reference in their entirety.

1. BACKGROUND OF THE INVENTION

The present invention relates to towel dispensing devices and more particularly to a towel dispensing device which warms the towel prior to removal of the towel from the dispensing device.

Towel dispensing devices have been widely used to dispense towels for a variety of uses. Towel dispensing devices have been commonly used to dispense disposable towels in public lavatories, doctors' offices, commercial and home kitchens, laboratories and many other locations where a stationary towel dispensing device easily serves the need to provide a disposable towel for washing or drying of the user's hands.

Portable towel dispensing devices have also been widely used in the form of face or hand tissue boxes. Disposable towels or towelettes which are of more durable construction than common tissue have also been packaged and dispensed from portable dispensing devices. The disposable towels or towelettes are premoistened and placed in a dispensing container which is substantially leak-resistant. The portable dispensing devices frequently have a cap, snap lid or some closing mechanism to minimize evaporation. Typically such dispensing devices are not reusable and easily crack or break with use. In addition, the solution often evaporates over time, rendering the entire dispensing device worthless because the solution has evaporated and the towels are no longer moist. Frequently, such dispensing devices have contained towels or towelettes which have been pre-moistened with an isopropyl alcohol-based solution. The alcohol-based solution when contacted to the skin typically produces a cold sensation to the user; and, when applied to the skin of an infant, the alcohol-based solution produces a predictable cold sensation which can be discomforting. Individual towels or towelettes are also available in individual wrapped packets, often made of metal foil or paper. However, these packets are not user friendly and are costly and often difficult to open. For each towel you wish to use, you must tear open a packet. Furthermore, these types of towels have little strength and fall apart easily.

Thus, there exists a need for a disposable pre-moistened towel dispenser which provides a pre-moistened towel which is warm to the touch and avoids the discomforting sensation of cold on the skin of the user.

2. SUMMARY OF THE INVENTION

It is an object of the present invention to provide a pre-moistened towel dispenser which provides a pre-moistened towel that is warm to the touch. It is a second object of the present invention to provide a pre-moistened towel dispenser which is warmed by electrically generated radiant heat. It is a third object of the invention to provide a pre-moistened towel dispenser which is warmed by hot vapor generated from within the towel dispenser. It is a fourth object of the invention to provide a non-disposable dispenser to which can be added non-moistened towels and various selected solutions to pre-moisten the towels. It is a fifth object of the invention to provide a non-disposable dispenser with multiple chambers and to place in each chamber non-moistened towels and various selected solutions to pre-moisten the towels contained in that chamber. These and other objectives are achieved by the present invention.

3. BRIEF DESCRIPTION OF THE DRAWINGS

4. DETAILED DESCRIPTION OF THE INVENTION

Figure 1:
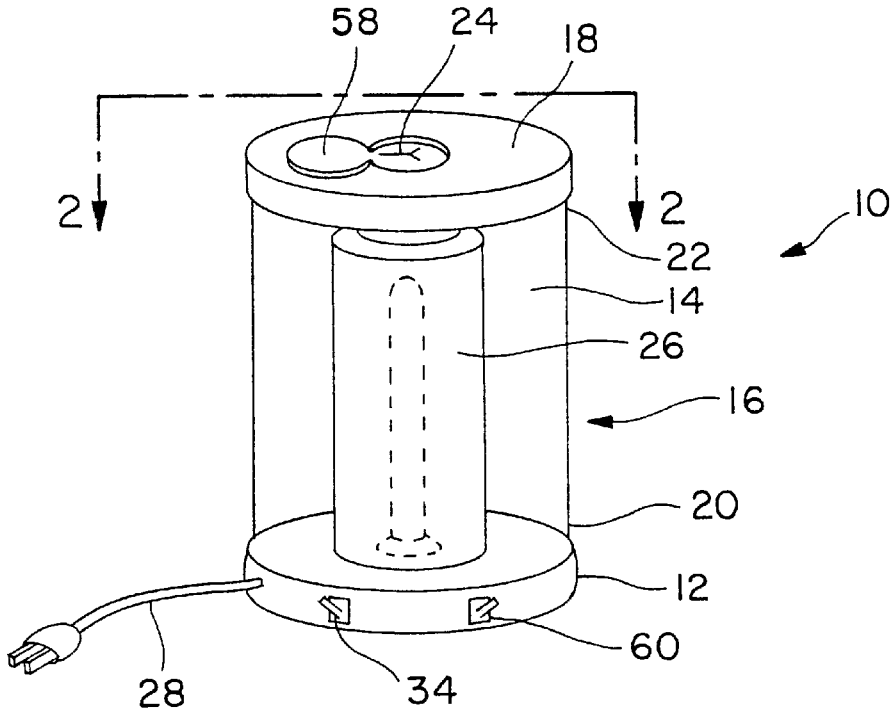
FIG. 1 is a perspective view of a warm towel-dispensing device embodying the principles of the present invention.
Figure 2:
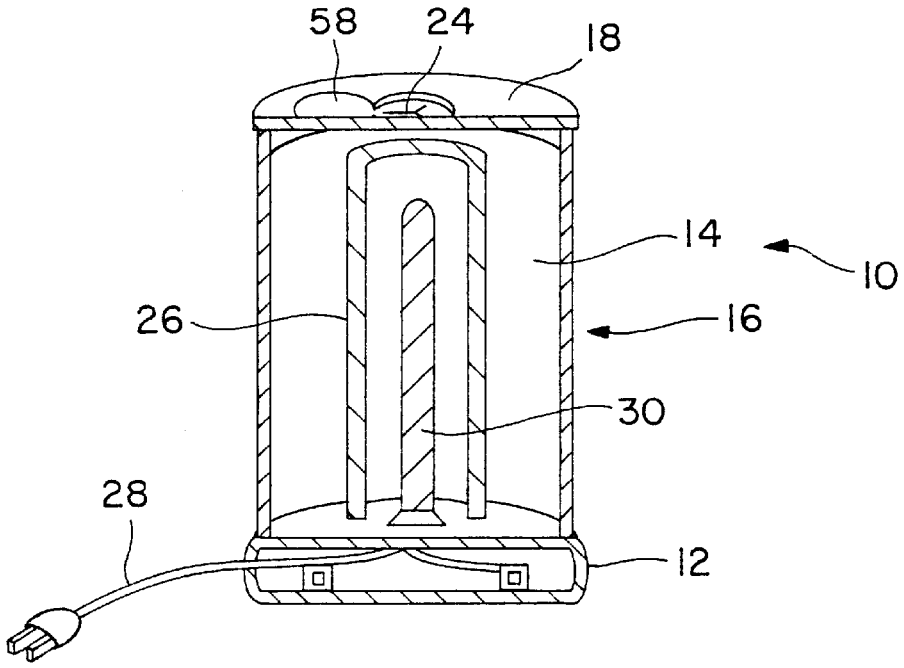
FIG. 2 is a sectional view of the warm towel-dispensing device of FIG. 1 taken along line 2—2.
Figure 3:
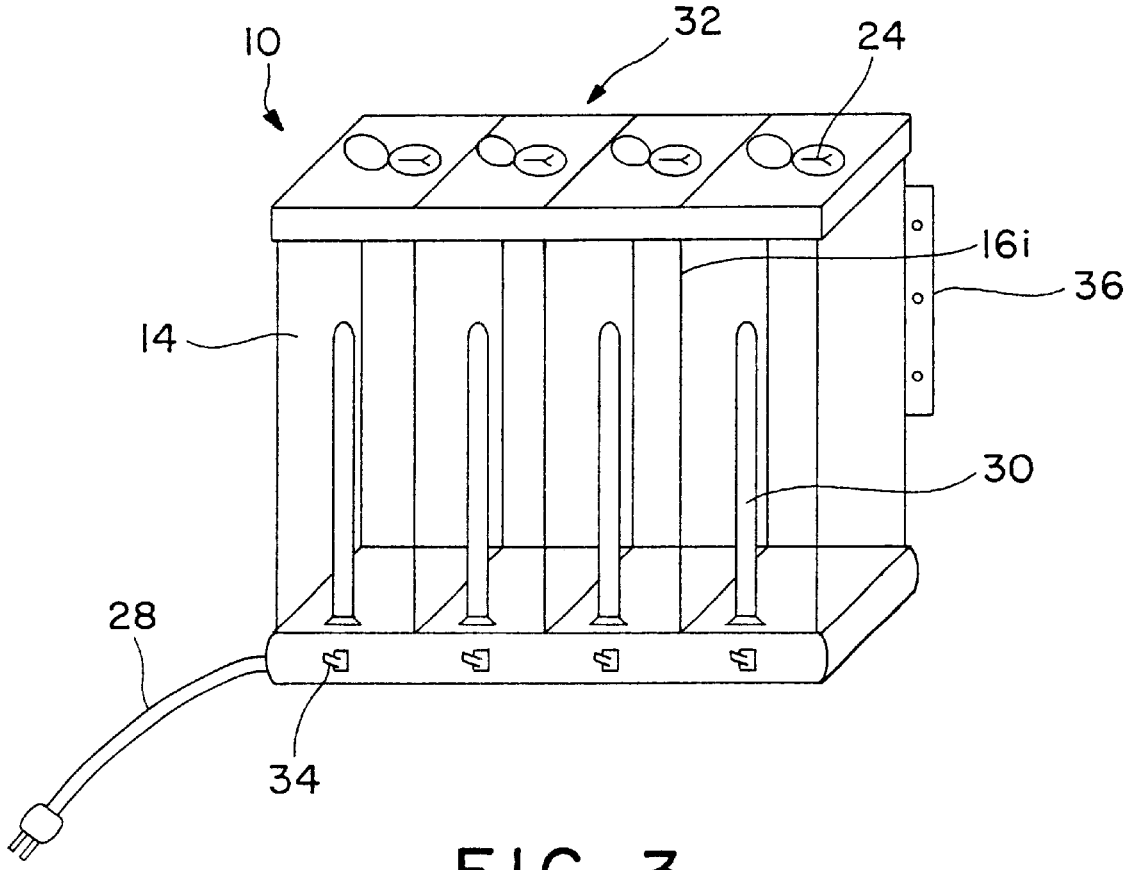
FIG. 3 is a perspective view of the warm towel-dispensing device of FIG. 1 configured to have serial dispensing units.

With reference to FIGS. 1–3, a preferred embodiment of a device for dispensing warm towels embodying the principles of the present invention is shown therein, generally indicated at 10. The dispensing device 10, includes a horizontally disposed base 12. If placed on a surface such as a table top, the dispensing device 10 can be supported by the base 12. Circumferentially attached to the upper surface of the base 12 and uniformly ascending to form a towel warming chamber 14 is the chamber wall, generally indicated at 16. The chamber wall 16 includes a base end 20 which is fixedly attached to the base 12 and an upper end 22. A chamber cover member 18 is removably attached to an upper end 22 of the chamber wall 16 so as to form a substantially leak proof seal. The cover member 18 is configured to define a towel extraction slit 24 through which warm moistened towels 26 can be dispensed as required.

Extending from the base 12 is a standard electrical conduction cord 28. At the proximal end of the electrical conduction cord 28 located within and secured to the base 12 is a radiant heating member 30 which extends into the warming chamber 14 for the purpose of providing radiant heat to the towels 26 which are enclosed within the warming chamber 14. It is also contemplated that other sources of electrical power are possible with the present invention, including, but not limited to batteries, rechargeable batteries, rechargeable battery packs, separate charging stands, or solar power devices. In addition, the present invention is not limited to a particular power source. For example, the present invention will work with both ac and dc currents.

When in use, the dispensing device 10 is provided with towels 26 which are configured in a roll which is disposed around, but not necessarily in contact with, the heating member 30. The innermost towel of the towels 26 in the roll is warmed by the proximity of the heating member 30. The innermost towel is partially extended through the extraction slit 24 of the cover member 18.

This embodiment of the dispensing device can be configured as shown in FIG. 3 such that a series of warming chambers, generally indicated at 32, can be serially aligned by making the interior walls 16*i* integral with each other. In this modified embodiment of the present invention, each separate warming chamber 14 can be warmed to a distinct temperature by a separate temperature controller 34. The individual temperature controller 34 for each warming chamber 14 is electrically connected to, and controls the degree of radiant heat generated by, the individual heating members 30. A configuration of serialized warming chambers 32, as shown in FIG. 3, would enable a user to provide different types of towels 26 with possibly different types of moistening agents to each of the separate warming chambers 14. The separate warming chambers 14 in the serialized configuration can also be maintained at different warming temperatures.

The dispensing device 10, as shown in FIGS. 1–3, has warming chambers 14 which can be warmed to a controlled temperature in a very short period of time if desired by setting the temperature controller 34 to provide a surge of electrical heating power. Thus, the pre-moistened towels can be quickly heated to the desired temperature and maintained in a desired temperature range by the temperature controller 34. It is also contemplated that the temperature controller will have a timing portion which will turn off the heating after a pre-selected period of time.

The dispensing device 10, when configured as a single warming chamber 14, as shown in FIGS. 1–2 or when configured as serialized warming chambers 32, as shown in FIG.3, can be alternatively mounted by side mounting members 36 to a vertical surface such as, for example, a wall.

Figure 4:
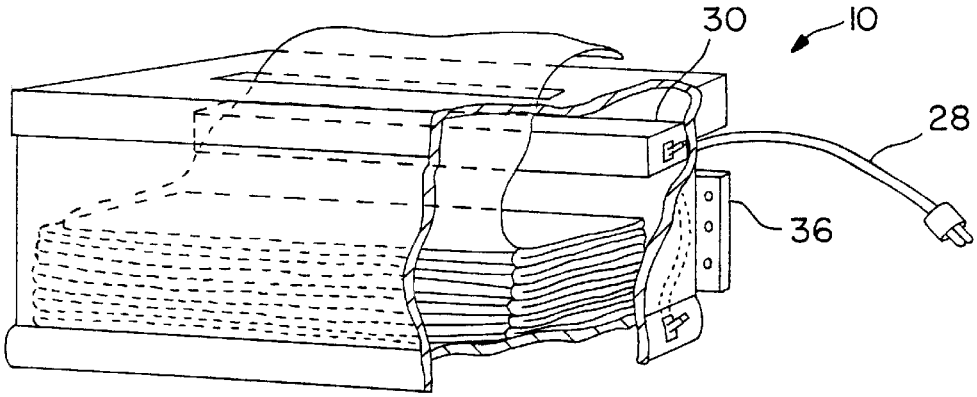
FIG. 4 is a fractional perspective view of a second embodiment of the present invention configured to receive and dispense warm towels which are in a folded array prior to dispensing.
Figure 5:
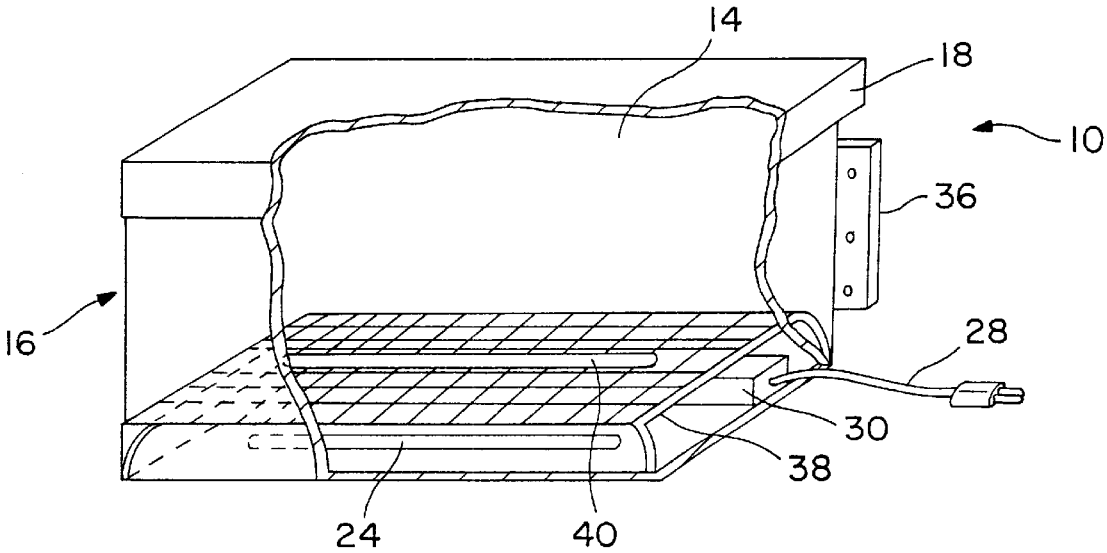
FIG. 5 is a fractional perspective view of the embodiment of the present invention shown in FIG. 4 further configured so as to enable the warm towels to be dispensed from the base of the dispensing device when the device is mounted on a wall.

An alternative embodiment of the dispensing device 10 embodying the principles of the present invention is shown in FIGS. 4–5. This embodiment of the present invention employs the same principles of the first embodiment of the dispensing device explained above with the general exception of using towels 26 which are configured in a folded manner rather than a rolled manner. As shown in FIG. 4, the heating member 30 is disposed in the dispensing device 10 along the longitudinal axis of the stored folded towels 26 and is fixedly attached to the chamber wall 16 above the towels 26 proximate to the cover member 18. This location for the heating member 30 places the source of the radiant heat nearest to the towel 26 which is most proximate to the extraction slit 24. The extraction slit 24 is longitudinally extended along the central portion of the cover member 18 to facilitate ease of removal of a folded towel 26. In addition, the extraction slit 24 and the cover member 18 act as a sealing device to hold moisture and heat in the warming chamber 14.

This alternate embodiment can be modified to permit removal of the folded towel from the base 12 of the warming chamber 14. The dispensing device 10 described in this alternate embodiment, whether configured with an upper extraction slit 24, as described above and as shown in FIG. 4, or modified to have a lower extraction slit 24, as shown in FIG. 5, can be mounted to a vertical surface, such as a wall, using side mounting members 36. The extraction slit 24 in this modification of the second embodiment is longitudinally extended along the central portion of the base 12 to facilitate removal of the most proximate folded towel 26. The heating member 30 is fixedly attached to the chamber wall 16 proximate to the base 12. A spacing grid 38 is fixedly mounted in the lower portion of the warming chamber 14 in such a manner as to provide an air space between the heating member 30 and the towel most proximate to the heating member 30. The towels 26 are supplied in a folded arrangement into the dispensing device 10 by removing the cover member 18 and placing the folded towels 26 atop the spacing grid 38. A grid slit 40 is located in the spacing grid 38 in a complementary arrangement to the extraction slit 24. This alignment of the grid slit 40 with the extraction slit 24 serves to facilitate removal of towels 26 located atop the spacing grid 38 out through the extraction slit 24.

Figure 6:
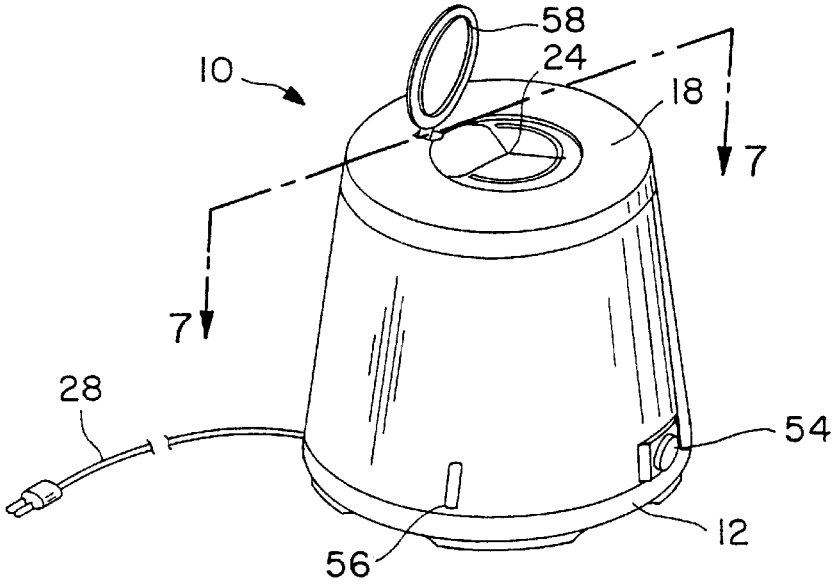
FIG. 6 is a perspective view of a third embodiment of the present invention having a vapor heat producing system.
Figure 7:
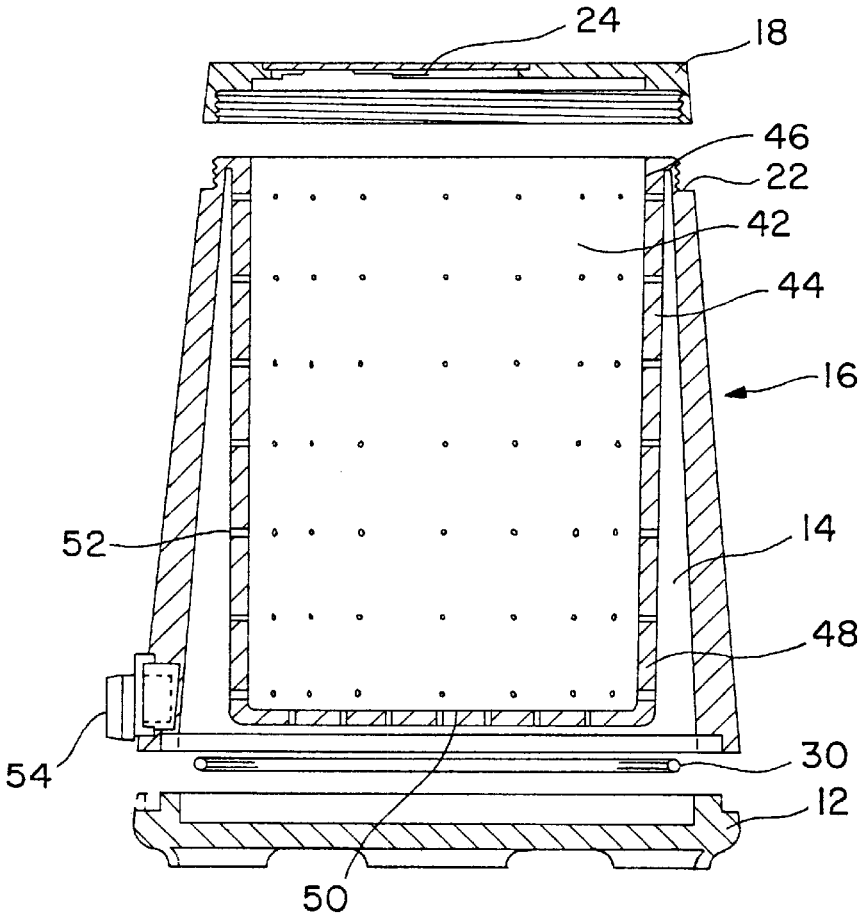
FIG. 7 is a sectional view of the embodiment of the present invention shown in FIG. 6 taken along line 7—7.

Yet another embodiment of the dispensing device 10 embodying the principles of the present invention is shown in FIGS. 6–7. This embodiment of the present invention employs the same principles of the first embodiment of the dispensing device explained above with the general exception of the method used to heat the towels 26 prior to dispensing them.

This embodiment of the dispensing device 10 includes an inner chamber 42 defined by a continuous laterally enclosing inner chamber wall 44. The inner chamber wall 44 includes a top end 46 and a bottom end 48. The top end 46 is circumferentially connected to the upper end 22 of the warming chamber wall 16. The bottom end 48 of the inner chamber wall 44 is integrally formed with, and terminated by, the bottom surface 50 of the inner chamber 42. The inner chamber wall 44 and the bottom surface 50 define a plurality of openings 52 which permit the movement of warm air or steam from the warming chamber 14 to the inner chamber 42. The heating member 30 of the third embodiment of the present invention is located in the base 12 of the device and is generally horizontally disposed proximate to the warming chamber 14. Water or other fluids can be placed in the inner chamber 42 after removal of the cover member 18. The water or other fluid placed in the inner chamber 42 will drain through the openings 52 of the inner chamber 42 into warming chamber 14. Towels 26 which can be configured in a roll are placed in the inner chamber 42 prior to securing the cover member 18. A time adjuster 54 can be electrically connected to the heating member 30 for the purpose of controlling the amount of heat generated and transmitted to the fluid in the warming chamber 14. The chamber wall 16 is provided with a fluid level indicator 56 which assists the user in determining if additional fluid must be added prior to operation.

In operation of this embodiment, after the water or other fluid capable of producing warmed vapor has been placed in the warming chamber 14 through the opened cover member 18, the time adjuster 54 is set to a selected time during which electrical power is provided to the heating member 30. The time is selected to permit sufficient heat to be generated by the heating member 30 so as to cause the water or other fluid in the warming chamber 14 to begin to convert to warmed vapor. The vapor thus generated passes through the openings 52 into the inner chamber 42 and warms the towels 26 there present. The user extracts a towel 26 thus warmed through the extraction slit 24 located in the central area of the cover member 18.

Optional to all embodiments of the present invention described above is an extraction slit cover 58 which can be removably secured over the extraction slit 24 to reduce the effects of evaporation. The time adjuster 54 can also be modified for use as a warming time controller for any embodiment of the present invention. Optionally, a heat intensity controller 50 can be provided for any embodiment of the present invention for the purpose of controlling the degree of heat to which the heating element 30 warms the warming chamber 14. Examples of heat intensity controllers which can be used in the present invention include, for example, a mechanical thermostatic control assembly, an electronic thermostatic control assembly and the like.

Any of the embodiments described herein above can be used for a variety of personal, medical, or industrial applications. It is contemplated that this invention can be used for cradle to grave applications. For example, baby wipes, face cleaning, cosmetic removal, nail polish removal, skin tones, skin conditions, bug repellant, skin tan lotion or sun block, shaving applications and so forth. It is also contemplated that this invention will accommodate various and multiple solutions and formulations having a wide variety of properties and uses. For example, antibacterial, antimicrobial, astringent, stain removal, glass cleaning, grease removal and so forth are contemplated. In addition, it is also contemplated that the device may be used for one application and then with the addition of a different solution and towel another completely different application is possible. Thus, the device may be used for multiple serial applications. It is also contemplated that in some of the applications it will not be desirable to heat the solution and the towels. Thus, the solution warming aspect of this invention does not have to be used. The uses for personal hygiene and for infant care or elderly care are not restricted to home use; but, could easily be adapted to public uses in food service establishments, large kitchen facilities, hotels, hospitals, emergency rooms, doctor offices, school rooms, nurses offices, public restaurants and public lavatories. Industrial applications of the present invention can vary from uses in laboratories to provide spill cleansing, with neutralizing solutions in the warm moistened towels to intense solvents necessary to remove stains not as well-treated with room temperature solvents. Embodiments using serially arranged warming chambers as shown in FIG. 3, could have both medical and industrial applications wherein each of the warming chambers contains different textured towels, towels wetted with different solutions, and/or towels prepared for use at different degrees of temperature. It is also contemplated that a variety of towel types, shapes and sizes can be used. The particular configuration of the towels (e.g., vertical roll, horizontal roll, folded vertical, folded horizontal, or doughnut-shape roll) is more a function of the design of the dispensing device.

Although a preferred embodiment and alternative embodiments of the present invention has been described in detail hereinabove, it should be clearly understood that many variations and/or modifications of the basic inventive concepts herein taught which may appear to those skilled in the art will still fall within the spirit and scope of the present invention as defined in the appended claims.

I claim:

1. A combination, comprising:

a multi-chamber non-disposable dispensing device;

non-moistened towels; and one or more solutions to moisten the towels.

2. The combination of claim 1, wherein the multi-chamber non-disposable dispensing device comprises:

a base for supporting said device on a surface;

a warming chamber circumferentially defined by chamber walls, said chamber walls having a base end and an upper end, said base end being fixedly attached to an upper surface of said base such that said base defines a lower limit of said warming chamber and said upper end terminating distal to said base;

a cover member removably attached to said upper end of said chamber walls, said cover member defining an extraction slit;

a heating member attached to said base and having a base end and a distal end, said distal end extending into said warming chamber; and an electrical conduction cord having a first end and a second end, said first end being electrically attached to said base end of said heating member and said second end extending out of said base for connection to an electrical power source.

3. The combination of claim 2, wherein said heating member extends upward into said warming chamber to a position proximate to but not in contact with said cover member.

4. The combination of claim 2, further comprising:

a time adjuster mounted on said device and electrically connected to said heating member for controlling an amount of time said heating member receives electrical power from said electrical conduction cord.

5. The dispensing device of claim 2, further comprising:

a heat intensity controller mounted on said device and electrically connected to said heating member for controlling a temperature of said heating member.

6. The combination of claim 2, wherein said cover member is equipped with a removable extraction slit cover configured so as to selectively cover said extraction slit.

7. The combination of claim 2, further defined by at least one side mounting member connected to said chamber walls and configured to facilitate mounting said device to a wall surface.

8. The combination of claim 2, wherein said warming chamber is configured as a plurality of individual and laterally attached warming chambers, said warming chambers each having a separate heating member.

9. The combination of claim 8, wherein said warming chambers are each configured with a heat intensity controller for individually selecting a warming temperature for each of said warming chambers.

10. A method, comprising:

adding to each chamber of a multi-chamber non-disposable dispensing device non-moistened towels; and adding solution to the chamber to moisten the towels;

thereby producing a multi-chamber non-disposable dispensing device containing moistened towels.

11. The method of claim 10, wherein the multi-chamber non-disposable dispensing device comprises:

a base for supporting said device on a surface;

a warming chamber circumferentially defined by chamber walls, said chamber walls having a base end and an upper end, said base end being fixedly attached to an upper surface of said base such that said base defines a lower limit of said warming chamber and said upper end terminating distal to said base;

a cover member removably attached to said upper end of said chamber walls, said cover member defining an extraction slit;

a heating member attached to said base and having a base end and a distal end, said distal end extending into said warming chamber; and an electrical conduction cord having a first end and a second end, said first end being electrically attached to said base end of said heating member and said second end extending out of said base for connection to an electrical power source.

12. The method of claim 11, wherein said heating member extends upward into said warming chamber to a position proximate to but not in contact with said cover member.

13. The method of claim 11, further comprising:

a time adjuster mounted on said device and electrically connected to said heating member for controlling an amount of time said heating member receives electrical power from said electrical conduction cord.

14. The method of claim 11, further comprising:

a heat intensity controller mounted on said device and electrically connected to said heating member for controlling a temperature of said heating member.

15. The method of claim 11, wherein said cover member is equipped with a removable extraction slit cover configured so as to selectively cover said extraction slit.

16. The method of claim 11, further defined by at least one side mounting member connected to said chamber walls and configured to facilitate mounting said device to a wall surface.

17. The method of claim 11, wherein said warming chamber is configured as a plurality of individual and laterally attached warming chambers, said warming chambers each having a separate heating member.

18. The method of claim 19, wherein said warming chambers are each configured with a heat intensity controller for individually selecting a warming temperature for each of said warming chambers.

19. A method, comprising:

providing a multi-chamber non-disposable dispensing device containing towels and a solution in each chamber;

dispensing all of the towels;

recharging the multi-chamber non-disposable dispensing device with non-moistened towels and solutions to moisten the towels.

20. The method of claim 19, wherein the multi-chamber non-disposable dispensing device comprises:

a base for supporting said device on a surface;

a warming chamber circumferentially defined by chamber walls, said chamber walls having a base end and an upper end, said base end being fixedly attached to an upper surface of said base such that said base defines a lower limit of said warming chamber and said upper end terminating distal to said base;

a cover member removably attached to said upper end of said chamber walls, said cover member defining an extraction slit;

a heating member attached to said base and having a base end and a distal end, said distal end extending into said warming chamber; and an electrical conduction cord having a first end and a second end, said first end being electrically attached to said base end of said heating member and said second end extending out of said base for connection to an electrical power source.

21. The method of claim 20, wherein said heating member extends upward into said warming chamber to a position proximate to but not in contact with said cover member.

22. The method of claim 20, further comprising:

a time adjuster mounted on said device and electrically connected to said heating member for controlling an amount of time said heating member receives electrical power from said electrical conduction cord.

23. The method of claim 20, further comprising:

a heat intensity controller mounted on said device and electrically connected to said heating member for controlling a temperature of said heating member.

24. The method of claim 20, wherein said cover member is equipped with a removable extraction slit cover configured so as to selectively cover said extraction slit.

25. The method of claim 20, further defined by at least one side mounting member connected to said chamber walls and configured to facilitate mounting said device to a wall surface.

26. The method of claim 20, wherein said warming chamber is configured as a plurality of individual and laterally attached warming chambers, said warming chambers each having a separate heating member.

27. The method of claim 26, wherein said warming chambers are each configured with a heat intensity controller for individually selecting a warming temperature for each of said warming chambers.

* * * * *

UNITED STATES PATENT AND TRADEMARK OFFICE

CERTIFICATE OF CORRECTION

PATENT NO. : 6,497,341 B1
DATED : December 24, 2002
INVENTOR(S) : Motsenbocker

It is certified that error appears in the above-identified patent and that said Letters Patent is hereby corrected as shown below:

Column 7,
Lines 34-37, please replace claim 18 with the following claim:

18. The method of claim 17, wherein said warming chambers are each configured with a heat intensity controller for individually selecting a warming temperature for each of said warming chambers.

Signed and Sealed this

First Day of April, 2003

JAMES E. ROGAN
*Director of the United States Patent and Trademark Office*